US005856630A

United States Patent [19]

Meger

[11] Patent Number: 5,856,630

[45] Date of Patent: Jan. 5, 1999

[54] HIGH VELOCITY ELECTROMAGNETIC MASS LAUNCHER HAVING AN ABLATION RESISTANT INSULATOR

[75] Inventor: Robert A. Meger, Crofton, Md.

[73] Assignee: The United States of America as represented by the Secretary of the Navy, Washington, D.C.

[21] Appl. No.: 252,474

[22] Filed: Jun. 1, 1994

[51] Int. Cl.[6] ..... F41B 6/00

[52] U.S. Cl. ..... 89/8; 124/3

[58] Field of Search ..... 42/76.02; 89/8, 89/16; 124/3

[56] References Cited

U.S. PATENT DOCUMENTS

| | | | |
|---|---|---|---|
| H1389 | 1/1995 | Weldon et al. | 89/8 |
| 1,370,200 | 3/1921 | Fauchon-Villeplee | 89/8 |
| 3,708,271 | 1/1973 | Loewenstein et al. | 65/512 |
| 3,746,086 | 7/1973 | Pasternak | 165/181 |
| 4,128,910 | 12/1978 | Nakata et al. | 15/110 |
| 4,337,826 | 7/1982 | Kritzer | 165/151 |
| 4,497,311 | 2/1985 | Brandenburg, Jr. | 126/606 |
| 4,681,015 | 7/1987 | Creedon | 89/8 |
| 5,183,957 | 2/1993 | Weldon et al. | 89/8 |
| 5,285,763 | 2/1994 | Igenbergs | 124/3 |
| 5,362,030 | 11/1994 | Iler, Jr. et al. | 256/65 |
| 5,375,504 | 12/1994 | Bauer | 89/8 |

OTHER PUBLICATIONS

Webster's II New Riverside University Dictionary, "lateral", 1984, p. 679.

Thio et al., "On Some Techniques to Achieve Ablation FKEE Operation of Electromagnetic Rail Launchers," Conf. Proc., 6th Symp. on Electromag. Launch Tech., Austin, TX, Apr. 28–30, 1992.

Thio et al., "The Projectile–Wall Interface in Rail Launchers," IEEE Trans. on Mag., vol. 29, No. 1, pp. 1213–1218, Jan. 1993.

Meger et al., "*NRL Experimental and Theoretical Research on the Acceleration of Plasma Armatures in Railguns,*" ALAA 93–3158, AIAA 24th Plasmadynamics & Laser Conference, Jul. 6–9, 1993, Orlando, FL.

*Primary Examiner*—Charles T. Jordan
*Assistant Examiner*—M. J. Lattig
*Attorney, Agent, or Firm*—Thomas E. McDonnell; Charles J. Stockstill

[57] ABSTRACT

A railgun having a composite insulator of laminated materials positioned between the rails. The composite insulator is comprised of a series of conducting layers oriented with the edges toward the bore, or barrel, of the railgun and their wide edges away from the bore. The laminate is layed lengthwise along the rails and is comprised of conducting layers of a high heat conductivity metal interleaved with an insulator material. The insulator material allows the composite insulator to stand off the voltages in a plasma armature even under high radiation flux conditions. Below the conducting material's ablation threshold the amount of ablation produced by the composite insulator is reduced by the reduction of insulator surface area exposed to the radiation. This allows better control of armature growth, mass acceleration by the plasma armature, secondary formation, and other factors normally found to retard projectile acceleration.

5 Claims, 3 Drawing Sheets

HIGH VELOCITY ELECTROMAGNETIC MASS LAUNCHER HAVING AN ABLATION RESISTANT INSULATOR

BACKGROUND OF THE INVENTION

1. Field of the Invention

The present invention relates generally to electric mass launchers, and more particularly to a railgun using an ablation resistant or composite insulator within the bore of a railgun electric mass launcher.

2. Description of the Related Art

Electric mass launchers have been investigated, in various forms, for several decades. One form of an electric launcher is called a railgun. A railgun is basically a linear motor for driving a projectile along a barrel. The barrel of the railgun is generally comprised of rails and an insulator material forming a bore, an armature located within the bore and an electrical power source which supplies the electrical current for driving the armature along the bore.

The railgun electric mass launcher 10, FIG. 1, uses a set of parallel conducting rails 12*a* and 12*b* separated by insulators (not shown), and a current shunt 14, called an armature which is free to slide between the rails 12*a* and 12*b*. Current 16 from an external source (not shown), such as a capacitor bank, battery bank, homopolar generator, or other high current power supply, is driven down one rail 12*a*, through the armature 14 and back along the other rail 12*b*. The insulators must be able to hold off the voltage between the rails 12*a* and 12*b* which can range from 10–500 v, depending upon the type of armature 14. The voltage across the rails 24*a* and 24*b* for a solid metal armature 14 is in the 10–50 v range. The magnetic field produced by the current 16 in the rails 12*a* and 12*b* applies a force on the current 16 driven through the movable armature 14. Such force is perpendicular to both the magnetic field direction and the direction of the current flow in the armature 14 and has a magnitude proportional to their product. In the railgun 10 this force is applied along the axis of the rails 12*a* and 12*b*, accelerating the armature 14 from the breech 18 to the muzzle end 19 of the railgun 10. The accelerated mass may be a solid mass such as an insulating jacket, called a sabot 21, encasing a solid projectile 22, as shown in FIG. 2. For low velocity applications (<1.5 km/s) the sabot 21 is usually made of a sliding metal structure which makes good electrical contact with the conducting rails 24*a* and 24*b*. As the velocity increases into the 1–2 km/s range, the sliding metal-to-metal contact becomes resistive, due to localized arcs (not shown) which form between the contacts between the rails 24*a* and 24*b*, and the sliding metal sabot. Eventually the current 28 contact transitions into a single large area arc 26 which trails behind the solid armature. This arc 26, known as a plasma armature, is comprised of a high pressure (>100 atmospheres), partially ionized gas distribution which fills the region between the conducting rails 24*a* and 24*b*. The current 28 is conducted between the rails 24*a* and 24*b* by this plasma distribution. Plasma armatures 26 are more resistive than solid metal armatures producing higher voltages across the arc 26. These voltages can be as high as 300–500 v depending on the current driven through the plasma. The magnetic field from the rails 24*a* and 24*b* causes a force on the current through the plasma armature 26 directed toward the muzzle 29. This force compresses the gas trapped between the arc 26 and the rear of the sabot 21 and the projectile 22 is accelerated down the bore 24 by the high pressure gas. Pressures driving the sabot 21 along the bore 24 can be ~1,000 atmospheres allowing high velocities to be reached in relatively short barrels. Such railguns have been able to accelerate gram-sized masses to ~8 km/s and 600 g masses to ~4 km/s.

The materials that comprise the bore of the railgun are very important to its operation. In most cases it is the bore materials that limit the performance of the railgun. Local pressures in the armature can reach 1000 atmospheres over the plasma armature length which is typically several bore diameters long. Thus the bore walls, including the seal between the rails and the insulators, must be able to withstand the full armature gas pressure. Under these extreme pressures the rails and insulators tend to expand outward measurably, even with a high pre-load compression provided by the surrounding support structure. Thus the bore materials must be able to flex sufficiently to recover from the high gas pressure without losing their high pressure seal, cracking, or permanently deforming. In general metals are better at both resisting the pressure and at recovering from the localized flexing associated with the moving pressure distribution. Some insulators, such as ceramics, can withstand the pressure but tend to crack or craze under localized stress. Softer materials can compress and tend not to return to their original shape and size. The expansion can also affect the sliding high pressure seal between the bore and the projectile. If the rails and the insulators expand too much they can allow gas to escape forward past the projectile. This lowers the available pressure to accelerate a projectile. The escaping gas which blows by the projectile can also break down and lead to precursor arcs forming in front of the projectile. Such arcs can divert current from the armature and further decrease the acceleration. The smoothness of the bore wall surface is also important. The smoother the surface, the better the seal. Thus cracks or pits which are left on the bore wall must be smoothed or honed periodically. The wall material must resist damage while being able to be smoothed if necessary. Soft insulator materials or materials that crack under stress have to be replaced often which can severely restrict the utility of hypervelocity plasma armature railguns.

In addition to the high pressures the plasma armature also bathes the bore walls in an extremely high particle and radiation flux. The plasma armature has a small but finite resistivity. Current driven through the armature resistively deposits a significant amount of heat energy in the plasma. Ohmic heating rates can reach ~300 megawatts during the typical 1–2 millisecond accelerating pulse. This energy heats the plasma in the armature which then reradiates the energy out of the armature plasma as black body electromagnetic radiation or hot particles. This radiated energy bathes the surrounding walls in the bore. Black body radiation from the hot gas distribution, which scales with the fourth power of the gas temperature, dominates the process. A equilibrium between the ohmic heating and the radiation is usually reached when the plasma temperature is 10,000°–20,000° K (1–2 eV). The armature is continually moving so a particular location on the rails or insulators is exposed to this radiated energy only when the armature passes. A typical location on the bore surface will see 100 s of kW/cm$^2$ for times ~100 microseconds. This amount of energy is sufficient to melt and ablate most materials from a surface. The threshold for ablation of the bore walls (heat flux necessary for ablation to occur for a given duration of exposure) depends on the wall material's heat capacity, heat conductivity, melting temperature, as well as the bore geometry. Likewise, the amount of material ablated from the surface once the ablation threshold has been reached depends on the amount of energy delivered to the surface as well as the heat of fusion (metal) or heat of formation (insulator) for the material. The heat of fusion or formation represents the energy required to release individual atoms of material from the surface. In general, metals have a relatively high ablation threshold (10–100 times larger) compared to the hydrocarbon-based insulators commonly used in railguns. Plastic insulators have ablation thresholds in the order of $10^4$ watts/cm$^2$ while metals have ablation thresholds in the order of $10^5$ W/cm$^2$. The amount of material ablated can be significant. The ablation products coming off the walls can enter the plasma arc and be accelerated along with the armature or can be left behind in the form of hot, partially ionized gas. Such hot gas trapped by the armature increases its length and mass and forces energy to be used accelerating the gas to the armature velocity. Hot gas left behind can lead to secondary arcs forming behind the plasma armature. Such secondary arcs divert current from he armature and slow the acceleration. Both cases, and other more subtle effects resulting from ablation, lead to a decrease in projectile acceleration. Thus control of the wall ablation is critical to optimizing the acceleration. The key to minimizing wall ablation is using ablation resistant materials for the rails and insulators.

A considerable effort has been expended trying to find the ideal material for rails and insulators. Metals are able to withstand high heat fluxes, but once the threshold for ablation is reached (100 s of KW/cm$^2$) they begin to ablate large amounts of mass due to their low heat of fusion (energy needed to separate atoms from the metal lattice). Insulators in general have a much lower ablation threshold (10 s of KW/cm$^2$) but a higher heat of formation (energy needed to break up the molecules into their constituents). This means that insulators, in general, start to ablate at a lower threshold level than metals but once the metal ablation threshold is reached, the metals will produce more ablated material than insulators. Most existing railguns use plastic (acrylic or epoxy resin) insulators which are particularly vulnerable to ablation. This results in rapid ablation of the surfaces and a flooding of the region in and around the arc with ablated hydrocarbons. Silicon carbide insulators have been tried but found to melt under the radiation flux and crack under the pressure. Diamond insulators are the best alternative, however, they cannot be fabricated in large volumes with existing technology. Machinable ceramics have relatively low ablation thresholds but tend to be brittle. Boron nitride has a high ablation threshold but tends to fill the bore with dust under high pressures. Epoxy materials like G-9 and G-10 (a form of fiberglass laminate bonded together with epoxy) are used routinely but produce copious amounts of ablated material. Such glass-epoxy materials also tend to delaminate under the high pressure and heat conditions in the barrel.

The ideal insulator would be a material that has a high ablation threshold as well as high heat of formation such as silicone carbide, alumina, or diamond. Unfortunately these materials are very expensive to make and tend to crack under extreme pressures.

SUMMARY OF THE INVENTION

The object of this invention is to provide an insulator for use in the bore of railgun electric mass launchers which can withstand the voltages, pressures, and high heat fluxes associated with plasma armature railguns.

Another object of this invention is to provide an insulator having reduced ablation characteristics thereby increasing the acceleration of the projectiles to velocities greater than 2 km/s.

Another objective of this invention is to provide an insulator that can be used at significantly higher power levels than existing insulators at less cost.

An objective of this invention is to provide a railgun with a smoother magnetic field structure in the bore region than existing railguns.

These and other objects are achieved by a high velocity railgun comprising a composite insulator of laminated materials positioned between the rails. The composite insulator is a lamination of high heat conductivity metal interleaved with a low ablation, or insulator, material layed lengthwise along the rails. This construction of the composite insulator allows the insulator to stand off the voltages in a plasma armature even under high radiation flux conditions. The amount of ablation produced by the composite insulator when exposed to a radiation flux below the metal layers ablation threshold is significantly reduced. This allows better control of armature growth, mass acceleration by the plasma armature, secondary formation, and other factors normally found to retard projectile acceleration.

DETAILED DESCRIPTION OF THE PREFERRED EMBODIMENT

Between figures, structural elements performing the same function will have like reference numbers.

Figure 1:
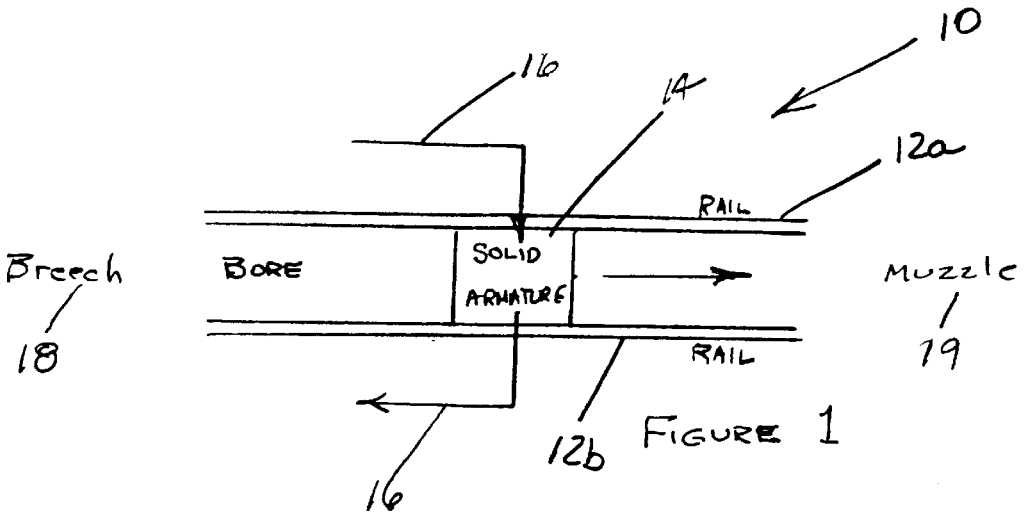
FIG. 1 depicts the prior art of a railgun having a solid armature.
Figure 2:
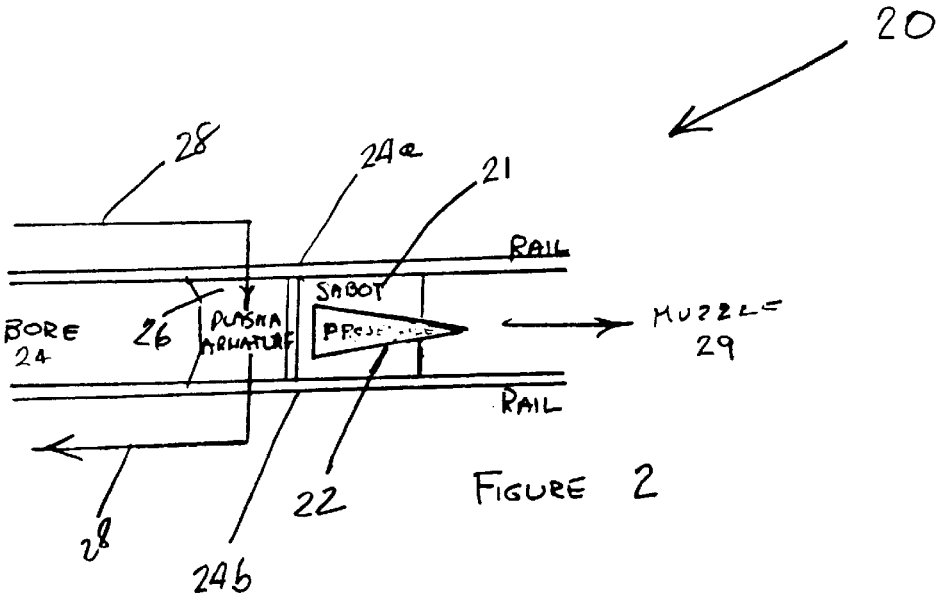
FIG. 2 depicts the prior art of a railgun having a plasma armature.
Figure 3:
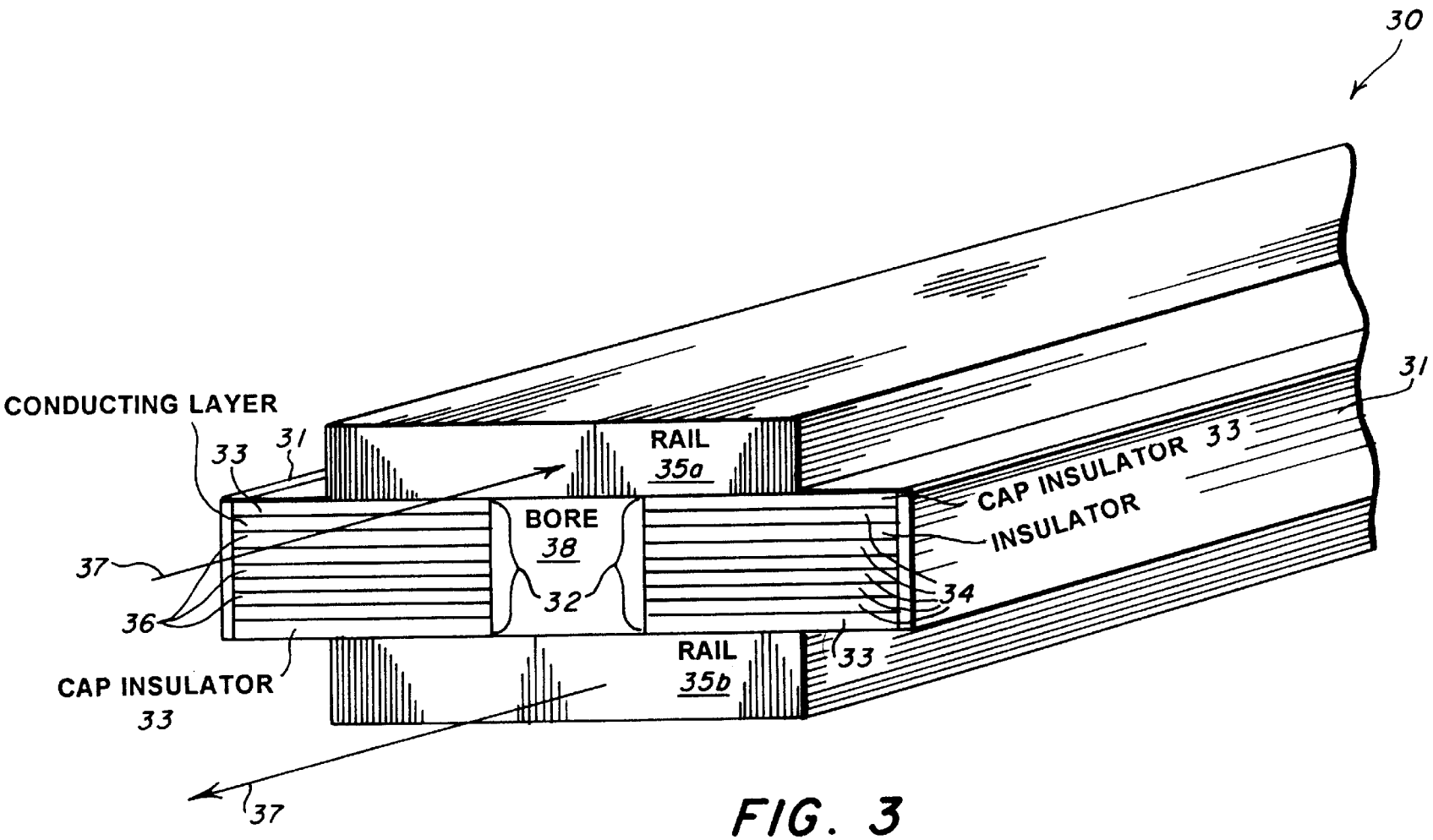
FIG. 3 is a schematic of a railgun having a composite insulator.

A railgun 30 having an ablation resistant, or composite insulator, 32 as an alternative to conventional insulators is shown in FIG. 3. The composite insulator 32, of the invention, is comprised of cap insulator layers 33, one or more conducting layers 34, and one or more insulating layers 36. The conducting layers are made of high heat conductivity metal 34 or metals having a $k_T$ greater than ~2 watts/cm-°K, such as copper or titanium, interleaved with insulation layers of a low ablation insulator material 36, such as ceramic, thin epoxy or plastic sheets, a non-conducting coating on the surface of the conducting layers 34, layers of highly resistive metal, or even a thin diamond coating on the surface of the conducting layers 34. Such insulator materials 36 have been found to provide excellent ablation resistance while maintaining a high strength to contain the pressures developed within the railgun bore 38. Low ablation insulator materials 36 are generally those materials producing less than $10^{-4}$ g/cm2 of ablation off the surface for the entire exposure to a plasma arc (not shown). The number of layers comprising a laminate forming the composite insulator 32 is determined by the required voltage standoff of the railgun 30, the desired field penetration time through the conducting layers 34 of the laminate, and the desired shape of the magnetic field structure. Optimally for a one cm bore, there are from 10 to 20 conducting layers 34 and 12 to 22 layers of insulation material 36 forming the composite insulator 32.

The thickness of the laminations is dependent upon the type of material used as a conducting layer 34. For copper the thickness of the conducting layer 34 lamination is from 0.5 to 1 millimeter; titanium would require a thicker lamination, from 2–4 millimeters. A typical thickness for the insulator material 36 is approximately 0.1 millimeter, the object being to have a thickness of the insulator material 36 as small as possible. However, the thickness of the conducting layers 34 and insulator material 36 can be equal across the entire composite insulator 32 or their respective thicknesses can be a function of position within the composite insulator 32. The laminations of the composite insulator 32 may either be bonded together utilizing an epoxy, or other bonding agent, or held in compression by an external clamp (not shown). The conducting layers 34 are preloaded by an insulator material 31 outside of the laminations of the composite insulator 32 to provide additional radial stiffness.

The insulator material 36 between the conducting layers 34 allows the composite insulator 32 to stand-off an armature voltage (~300–600 V), even under high radiation flux conditions (an energy flux $\geqq 10^3$ W/cm$^2$). Below the conducting layer's 34 ablation threshold, the amount of ablation produced by the composite insulator 32 is reduced by an amount equal to at least the reduction of insulator material 36 surface area exposed to the radiation using this invention. The insulator material 36 can be a ceramic, thin epoxy or plastic sheets, a non-conducting coating on the surface of the conducting layer 34, layers of metal having resistances so high the they will act as insulators (such as tungsten), or even a thin diamond coating on the surface of the conducting layer 34 so as to take advantage of diamond's high ablation threshold. (For a discussion of the theoretical framework of a railgun having a plasma armature, See, Thio et al., *On Some Techniques to Achieve Ablation Free Operation of Electromagnetic Rail Launchers*, Conf. Proc. 6th Symp. on Electromag. Launch Tech., Austin, Tex., Apr. 28–30, 1992, which is hereby incorporated by reference and also See, Meger et al., NRL *Experimental and Theoretical Research on the Acceleration of Plasma Armatures in Railguns*, AIAA 93-3158, AIAA 24th Plasmadynamics & Lasers Conf., Jul. 6–9, 1993, Orlando, Fla., which is hereby incorporated by reference.)

If the radiation flux (in W/cm$^2$), the heat flux due to the Joule heating of the armature (not shown) produced by the current driven by the external power source (not shown), is kept below the ablation threshold for the metal surfaces in the rails 35*a* and 35*b* and conducting layers 34 of the composite insulator 32; the amount of ablation will be significantly reduced. This establishes better control of armature growth, mass accretion by the plasma armature, secondary formation, and other factors that retard projectile acceleration.

Continuing to refer to FIG. 3, the horizontial plane of the conducting layers 34 and insulating material 36 forming the laminations of the composite insulator 32 are oriented toward and lengthwise along the bore 38 of the railgun 30. This orientation maximizes the stiffness of the insulator 32 to the pressure developed within the bore 38.

As previously noted, the conducting layers 34 are between insulating strips 36 whose thickness is preferably less than that of the conducting layers 34. Therefore, the total surface area of the laminations of conducting layers 34 facing the interior of the bore 38 is larger than the total area of the laminations of insulator material 36.

The composite insulator 32 structure is isolated electrically from the rails 35*a* and 35*b* so that when current 37 is driven into the rails 35*a* and 35*b*, on either side of the composite insulator 32, there is only a surface eddy current (not shown) driven in the conducting layers 34. This eddy current keeps the magnetic field from penetrating immediately into the interior of the conducting layers 34. The surface currents (not shown) in the conducting layers 34 will persist for a time related to the skin depth of the material comprising the conducting layer 34. The magnetic field will penetrate, however, through the insulation strips 36 of the composite insulator 32 and thereby into the interior of the bore 38 immediately. The delay in field penetration into the inside of the conducting layers 34 results in a smoothing and grading of the magnetic field (not shown) inside the launcher bore 38. The relevant time scale for field penetration into the conducting layer 34 is the local rise time of the current (not shown) in the railgun 30 at any given location in the bore 38 as the armature, or arc, (not shown) moves past a specific point on the composite insulator 32. At velocities of ~4 km/s for the arc (not shown) the rise time of the magnetic field in the vicinity of the composite insulator 32 is typically in the 10 microsecond regime. The thickness of the conducting layer 34 in the composite insulator 32 determines the speed with which the field penetrates into the conducting layer 34. For example, a 1 millimeter copper strip will allow the field to penetrate in 10 microseconds. Metals more resistive than copper would have to be thicker so as to achieve the penetration time of copper. Voltage stand off of the composite insulator 32 is provided by the insulator material 36 between the conducting layers 34. Voltage standoff is the resistance of the composite insulator 32 to the voltage generated between the rails 35*a* and 35*b* and across the composite insulator 32 by a combination of the driving voltage (not shown) and the inductive voltage developed by the moving armature (not shown).

In the case where the composite insulator 32 is made up of conducting layers 34 and highly resistive (resistance greater than ~$10^{-6}$ Ω-cm) metal as an insulating material 36, the electric field between conducting layers 34 is resistively smoothed by the highly resistive metal layers used as insulating material 36.

The amount of mass produced by ablation in this system will be dominated by the metal (both from the rails 35*a* and 35*b* and from the conducting layers 34 in the composite insulator 32). As long as the radiation flux is below the metal ablation threshold (that point below which the heat conductivity of the metal is sufficient to carry away the incident heat flux without melting the surface), the amount of ablation produced by the bore 38 walls will be minimal.

Figure 4:
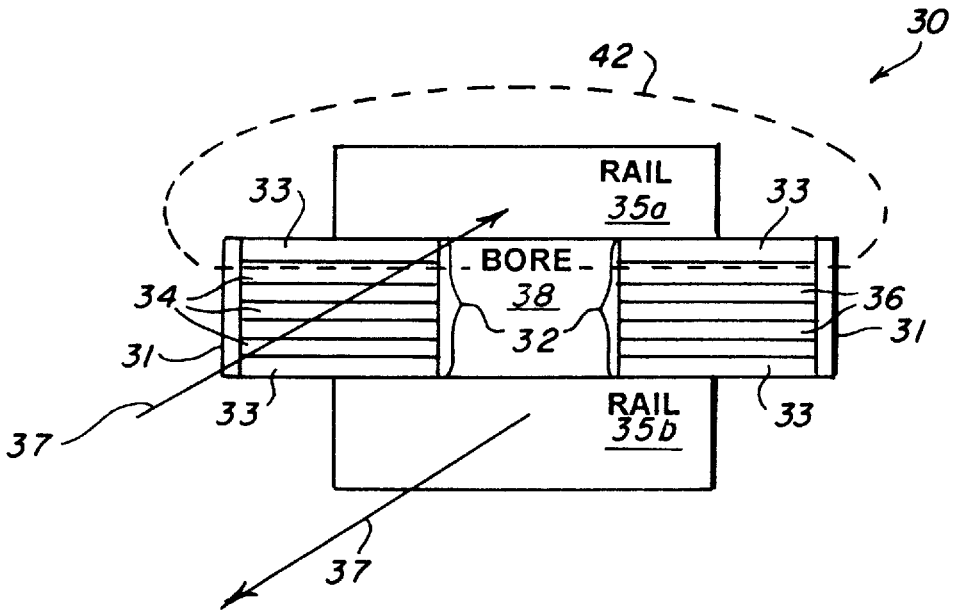
FIG. 4 is a schematic of the magnetic field structure of a composite insulator inside of the railgun barrel.

The advantages of using a composite insulator 32, as shown in FIG. 4, are several. The ablation from the surface of the composite insulator 32 near the arc (not shown) will be determined by the conducting layers 34 of the composite insulator 32 rather than the insulators 36. This will raise the threshold for ablation of the system closer to that of the conducting layers 34. One could program the current pulse in the armature (not shown) to keep the radiation hitting the walls below the ablation threshold (this threshold depends on the heat conductivity, heat capacity, and melting temperature of the material). In addition the strength of the insulator material 36 in the direction away from the bore 38 surface will be comparable to that of a solid metal structure. Heat conductivity away from the bore 38 region will allow more energy to be extracted, possibly through an external heat removal system.

The composite insulator 32 is capable of being machined or ground smooth periodically, if necessary. Fabrication of the composite insulator 32 is simple and inexpensive compared to other ablation materials such as ceramics. Controlling the field penetration into the composite insulator 32 by controlling the electrical conductivity and size or shape of the conducting layers 34 will also allow some degree of smoothing of the magnetic field structure in the vicinity of the armature. The use of highly resistive metal layers, rather than ceramic or other typical insulation material for insulators 36, allows the ablation to be further reduced while electrically grading the insulators 36 themselves.

An additional advantage of using the composite or resistive metal for an insulator 32 is the ability to control the magnetic field structure in the railgun bore. The material used for the conducting layers 34, as shown in FIG. 4, can exclude magnetic flux 42, or field, for a finite time. This forces the field 42 to penetrate horizontally in a straight line through the composite insulator 32 and into the bore 38 region by way of the insulation material 36 between the conducting layers 34. The field 42 will gradually penetrate into the conducting layers 34 of the composite insulator 32, eventually relaxing toward the solid insulator field structure. The rate that the field 42 penetrates will depend on the conductivity, thickness, and geometry of the conducting layers 34. The relevant time scale for the field shaping is the rise time of the current at a given location in the bore 38. This is a combination of the risetime of the current in the railgun (not shown) and the speed the armature (not shown) is moving past the point. Using copper lamination for the conducting layer 34, the field penetration time can be as long as 10 microseconds. Thus for at least the first 10 microseconds the field structure can be modified by the composite insulator 32 field penetration.

Figure 5A:
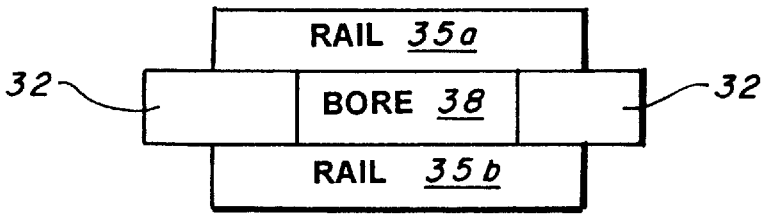
FIG. 5*a* depicts a railgun having a rectangular cross-section.
Figure 5B:
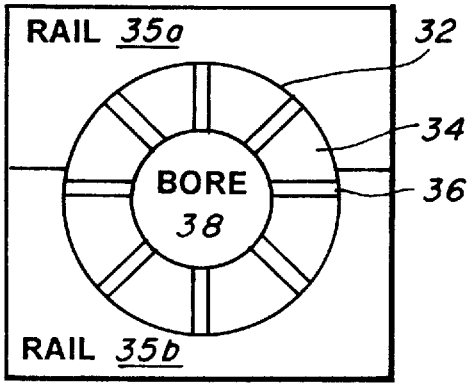
FIG. 5*b* depicts a railgun circular.

Although the preferred configuration of the railgun bore 38 is square, there is nothing to preclude the composite insulator 32 being of either a rectangular, FIG. 5*a*, or circular, FIG. 5*b*, or any other configuration desired by the designer.

The composite insulator has the advantages of being able to withstand the voltages, pressures generated in a plasma armature railgun bore, of limiting ablation and raising the ablation threshold of the bore as a whole close to that of the metal rather than the insulator material, and of permitting the control of the magnetic field shape in the armature region. As a result, the acceleration of the projectiles can be increased to velocities greater than 2 km/s utilizing lower power levels than existing railguns, at a less cost. These benefits make the invention of significant value to railgun operations.

It will be understood by those skilled in the art that still other variations and modifications are possible can be affected without detracting from the scope of the invention as defined by the claims.

What is claimed is:

1. A railgun comprised of:

a plurality of rails;

a laminated insulator comprised of laterally positioned layers of insulation material separated by a copper conducting layer;

said insulator being located between the rails so as to form a bore;

an armature located within the bore; and means for generating a current to be applied to the armature through the rails thereby causing a magnetic filed to be generated capable of accelerating the armature along the bore.

2. A railgun comprised of:

a plurality of rails;

a laminated insulator comprised of laterally positioned layers of insulation material separated by a copper alloy conducting layer;

said insulator being located between the rails so as to form a bore;

an armature located within the bore; and means for generating a current to be applied to the armature through the rails thereby causing a magnetic filed to be generated capable of accelerating the armature along the bore.

3. A railgun comprised of:

a plurality of rails;

a laminated insulator comprised of laterally positioned layers of insulation material separated by a conducting layer;

said epoxy insulator being located between the rails so as to form a bore;

an armature located within the bore; and means for generating a current to be applied to the armature through the rails thereby causing a magnetic filed to be generated capable of accelerating the armature along the bore.

4. A railgun, as in claim 1, wherein the insulation material is an epoxy.

5. A rail gun comprised of:

a plurality of rails;

a laminated insulator comprised of laterally positioned layers of insulation material separated by a conducting layer;

said insulation material is a diamond coating bonded to the conducting layer;

said insulator being located between the rails so as to form a bore;

an armature located within the bore;

means for generating a current to be applied to the armature through the rails thereby generating a magnetic field to accelerate the armature along the bore.

* * * * *